US011193294B2

(12) United States Patent
Lu et al.

(10) Patent No.: US 11,193,294 B2
(45) Date of Patent: Dec. 7, 2021

(54) DOUBLE VARIABLE SLIDING ISOLATOR

(71) Applicants: National Cheng-Kung University, Tainan (TW); WELL-LINK INDUSTRY Co., LTD, New Taipei (TW)

(72) Inventors: Lyan-Ywan Lu, Kaohsiung (TW); Han-Wei Huang, Taipei (TW); Chun-Lung Lee, New Taipei (TW)

(73) Assignees: National Cheng-Kung University, Tainan (TW); WELL-LINK INDUSTRY Co., LTD, New Taipei (TW)

( * ) Notice: Subject to any disclaimer, the term of this patent is extended or adjusted under 35 U.S.C. 154(b) by 0 days.

(21) Appl. No.: 16/841,617

(22) Filed: Apr. 6, 2020

(65) Prior Publication Data

US 2021/0310266 A1 Oct. 7, 2021

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04H 9/023
See application file for complete search history.

(56) References Cited

U.S. PATENT DOCUMENTS 4,974,378 A * 12/1990 Shustov ..... E02D 27/34 248/638
5,056,280 A * 10/1991 Shustov ..... E04H 9/023 52/167.5
6,123,313 A * 9/2000 Otsuka ..... E04H 9/023 248/580
6,321,492 B1 * 11/2001 Robinson ..... E02D 31/08 52/167.1
6,631,593 B2 * 10/2003 Kim ..... E04H 9/023 248/562
6,725,612 B2 * 4/2004 Kim ..... E04H 9/023 52/167.1
6,862,849 B2 * 3/2005 Kim ..... E04H 9/023 248/562
6,951,083 B2 * 10/2005 Kim ..... E04H 9/023 52/167.1

(Continued)

OTHER PUBLICATIONS

Lyan-Ywan Lu et al., "Theory and experimental study for sliding isolators with variable curvature", Earthquake Engineering and Structural Dynamics, Feb. 2011, pp. 1609-1627.

*Primary Examiner* — Andrew J Triggs
(74) *Attorney, Agent, or Firm* — JCIPRNET

(57) ABSTRACT

A double variable sliding isolator including a bottom sliding plate, a top sliding plate, and a friction piece is provided. The bottom sliding plate has a bottom sliding surface that has at least two curvatures. The top sliding plate is disposed over the bottom sliding plate and has a top sliding surface that has at least two curvatures. The friction piece is disposed between the top sliding plate and the bottom sliding plate and the friction piece is in contact with the bottom sliding surface and the top sliding surface. When an external force is applied to the bottom sliding plate and the top sliding plate, the bottom sliding plate and the top sliding plate will generate a relative displacement, so that the friction piece slides along the bottom sliding plate and the top sliding plate.

16 Claims, 16 Drawing Sheets

(56) References Cited

U.S. PATENT DOCUMENTS

| | | | | |
|---|---|---|---|---|
| 6,971,795 | B2 * | 12/2005 | Lee | E04H 9/023 14/73.5 |
| 7,547,142 | B2 * | 6/2009 | Robinson | E01D 19/04 248/560 |
| 7,784,225 | B2 * | 8/2010 | Kemeny | E04H 9/02 52/167.1 |
| 8,104,236 | B2 * | 1/2012 | Kemeny | E04H 9/023 52/167.5 |
| 8,484,911 | B2 * | 7/2013 | Zayas | E04H 9/023 52/167.5 |
| 8,745,934 | B2 * | 6/2014 | Kemeny | E04H 9/023 52/167.5 |
| 10,273,680 | B2 * | 4/2019 | Massa | E01D 19/04 |
| 2003/0099413 | A1 * | 5/2003 | Lee | E04H 9/023 384/36 |
| 2003/0167707 | A1 * | 9/2003 | Tsai | E01D 19/04 52/167.5 |
| 2006/0174555 | A1 * | 8/2006 | Zayas | E04H 9/023 52/167.4 |
| 2012/0222369 | A1 * | 9/2012 | Kemeny | E04H 9/02 52/167.5 |
| 2013/0247505 | A1 * | 9/2013 | Kemeny | E04H 9/02 52/741.3 |
| 2018/0195267 | A1 * | 7/2018 | Massa | E04H 9/021 |

* cited by examiner

DOUBLE VARIABLE SLIDING ISOLATOR

BACKGROUND OF THE INVENTION

1. Field of the Invention

The invention relates to an isolator, and in particular relates to a double variable sliding isolator having variable curvatures.

2. Description of Related Art

In order to counteract the impacts of earthquakes on large structures, such as buildings, bridges and elevated roads, or processing machine, isolators capable of buffering or absorbing seismic external forces have been developed. An isolator is usually installed between a building or a processing machine and the ground and has an effect of reducing the seismic external forces transferred to the building or the processing machine, so as to reduce the vibration amplitude of the building or the processing machine, thereby maintaining the structure stability and also preventing the building or the processing machine from being damaged.

An existing isolator, such as a friction pendulum isolator (FPI), has been widely used in buildings or processing machines. The FPI has a good seismic isolation effect in regular (far-field) earthquakes. According to the research results in recent years, the FPI is prone to cause a resonance behavior in near-field earthquakes with long period components, which will increase the risk of failure of the isolator. In order to ensure the safety of buildings or processing machines under the action of larger seismic forces or near-field ground motions, the current improvement solution is to increase the overall size of the FPI to improve the seismic isolation efficiency and safety. However, the increase in size has the disadvantages of increasing isolator installation space occupation and manufacturing cost.

SUMMARY OF THE INVENTION

The invention provides a double variable sliding isolator having different curvatures and capable of avoiding the problem of excessive isolator displacement when subjected to near-field earthquakes. Furthermore, under a same displacement capacity, compared with an existing single-pendulum isolator, the double variable sliding isolator has the advantages of smaller size, flexibility and variability.

The double variable sliding isolator provided by the invention includes a bottom sliding plate, a top sliding plate, and a friction piece. The bottom sliding plate has a bottom sliding surface that has at least two curvatures. The top sliding plate is disposed over the bottom sliding plate and has a top sliding surface that has at least two curvatures. The friction piece is slidably disposed between the top sliding plate and the bottom sliding plate and is in contact with the bottom sliding surface and the top sliding surface respectively. When an external force is applied to the bottom sliding plate and the top sliding plate, the bottom sliding plate and the top sliding plate will generate a relative displacement, so that the friction piece slides relative to the bottom sliding surface and the top sliding surface.

Based on the above, the double variable sliding isolator provided by the invention has the top sliding plate and the bottom sliding plate, and each of the top sliding surface and the bottom sliding surface respectively has at least two curvatures. Different from an existing single-pendulum isolator having a constant curvature, a double variable sliding isolator having variable curvatures is capable of avoiding the problem of excessive isolator displacement when subjected to near-field earthquakes with long-period components. Furthermore, in a seismic motion, the normalized restoring force and the isolator displacement of the double variable sliding isolator are not of a linear relationship, but a non-linear relationship based on chosen different curvatures. Therefore, the double variable sliding isolator has more flexibility and variability and is suitable for buildings or machines with different seismic isolation requirements.

Further, compared with the existing single-pendulum isolator, under the same demand on the isolator displacement, the double variable sliding isolator provided by the invention has the advantage of smaller size.

DESCRIPTION OF THE EMBODIMENTS

Figure 1A:
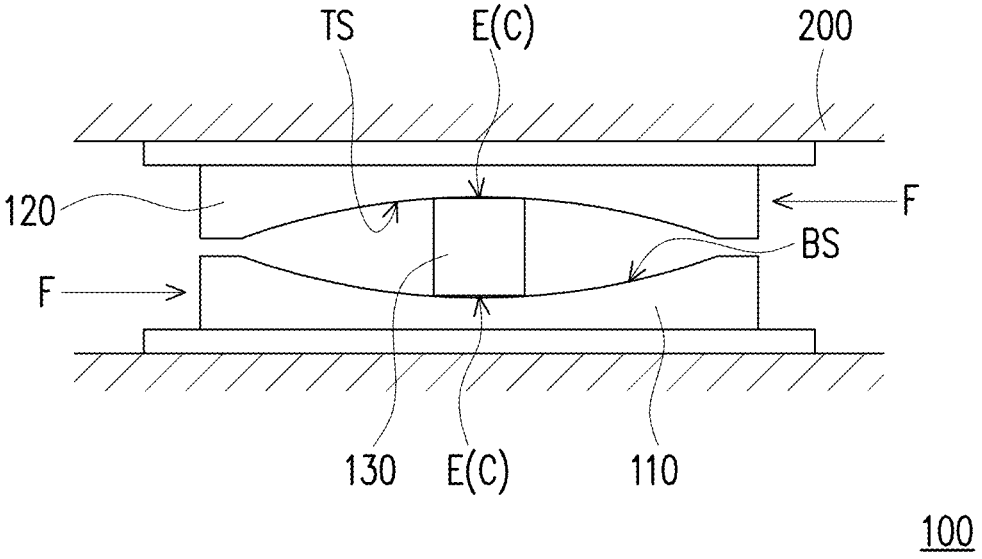
FIG. 1A is a schematic plane diagram of a double variable sliding isolator according to an embodiment of the invention.
Figure 1B:
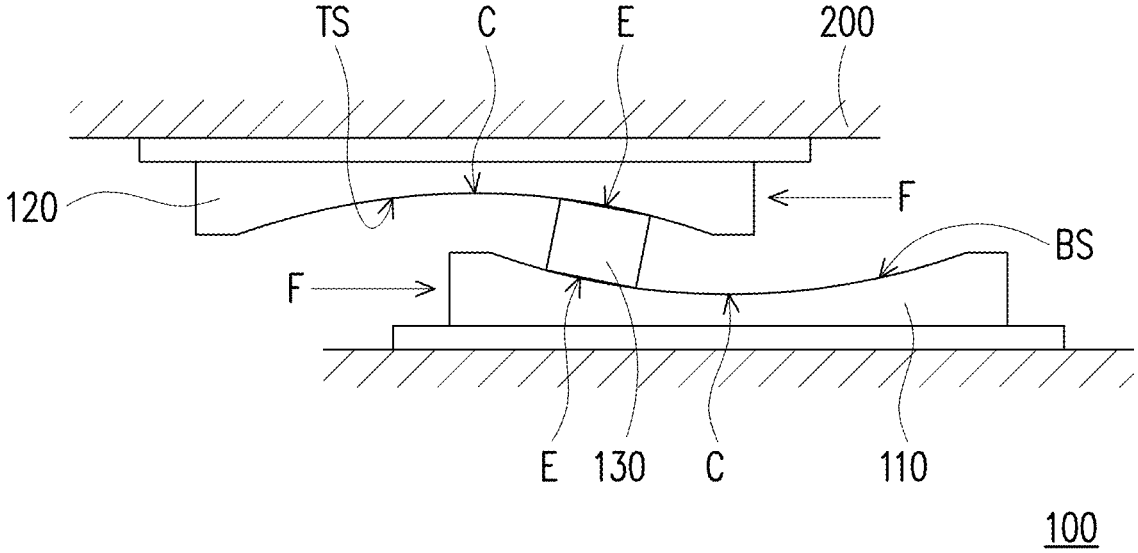
FIG. 1B is a schematic action diagram of a relative displacement of the double variable sliding isolator in FIG. 1A.

FIG. 1A is a schematic plane diagram of a double variable sliding isolator according to an embodiment of the invention. FIG. 1B is a schematic action diagram of a relative displacement of the double variable sliding isolator in FIG. 1A.

Referring to FIG. 1A to FIG. 1B, a double variable sliding isolator 100 provided by the invention is adapted to a building or a processing machine (not shown in figures), and is configured to absorb a portion of seismic forces to effectively reduce a vibration amplitude of the building or the processing machine, so as to maintain a structure stability and safety of the building or the processing machine.

The double variable sliding isolator 100 provided by the invention includes a bottom sliding plate 110, a top sliding plate 120, and a friction piece 130. The bottom sliding plate 110 has a bottom sliding surface BS, and the bottom sliding surface BS has at least two curvatures. The top sliding plate 120 is disposed over the bottom sliding plate 110 and has a top sliding surface TS, and the top sliding surface TS has at least two curvatures.

The friction piece 130 is slidably disposed between the top sliding plate 120 and the bottom sliding plate 110, and two ends E of the friction piece 130 are in contact with the bottom sliding surface BS and the top sliding surface TS respectively. When an external force F is applied to the bottom sliding plate 110 and the top sliding plate 120, the bottom sliding plate 110 and the top sliding plate 120 will generate a relative displacement (as shown in FIG. 1B), so that the friction piece 130 slides relative to the bottom sliding surface BS and the top sliding surface TS.

For example, in the present embodiment, the bottom sliding plate 110 is fixed on the ground G, and the top sliding plate 120 is fixed on a seismic isolated object 200. When the external force F is sequentially transferred from the ground to pass through the bottom sliding plate 110, the friction piece 130 and the top sliding plate 120, the top sliding plate 120 and the bottom sliding plate 110 are changed from an initial state (that is, the seismic isolated object 200 is in a stationary state) as shown in FIG. 1A to a displacement state (that is, the seismic isolated object 200 is in a vibratory state) of the bottom sliding plate 110 and the top sliding plate 120 as shown in FIG. 1A. The friction piece 130 will slide back and forth between the bottom sliding surface BS and the top sliding surface TS, so as to reduce the transmitted seismic force onto the seismic isolated object 200. Through curved surface properties of the bottom sliding surface BS and the top sliding surface TS, the seismic isolated object 200 may slide to the center C of the bottom sliding plate 110 and the top sliding plate 120 due to a self-weight of the isolated object 200; and through a cyclic motion, the seismic energy generated by external force F is gradually consumed to finally restore the initial state as shown in FIG. 1A.

The bottom sliding surface BS of the bottom sliding plate 110 and the top sliding surface TS of the top sliding plate 120 are symmetrically disposed, and mechanical properties acting on the bottom sliding surface BS and the top sliding surface TS during a seismic isolation process of the friction piece 130 are symmetrical, so that stresses at two ends of the friction piece 130 are equally distributed to avoid abrasion of the friction piece 130 due to uneven stresses.

Referring to FIG. 1A and FIG. 1B, in the present embodiment, the friction piece 130 is integrally formed and presents a circular column. In other embodiments, the friction piece 130 may be a triangular column, a rectangular column, a polygonal column, or other shapes. The friction piece may be made of ultra-high-molecular-weight polyethylene, polytetrafluoroethylene, rubber, or other similar flexible materials.

Figure 2A:
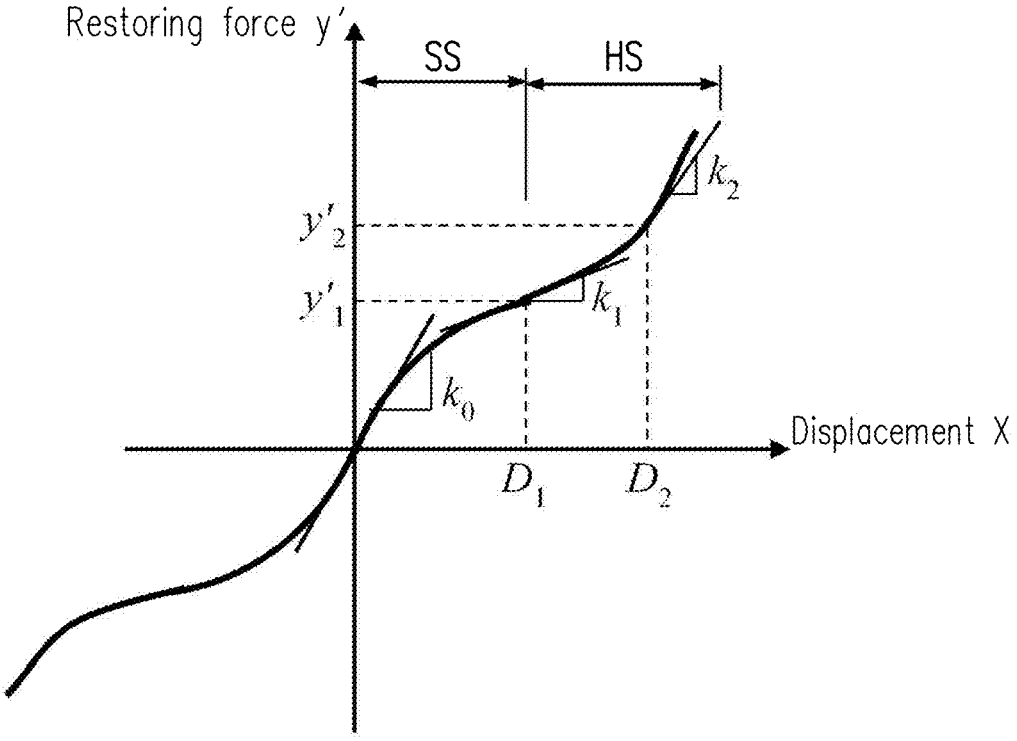
FIG. 2A is a relationship diagram between the restoring force and the isolator displacement of a double variable sliding isolator adopting a curved surface function of an eighth-degree polynomial.

FIG. 2A is a relationship diagram between the restoring force and isolator displacement of a double variable sliding isolator adopting a curved surface function of an eighth-degree polynomial.

Referring to FIG. 2A, the horizontal axis represents the isolator displacement X (that is, a relative displacement of the isolator), the vertical axis represents the normalized restoring force y' (that is, a restoring force measured in a vibration process of the isolator), and the curved surface functions of the top sliding surface TS and the bottom sliding surface BS may consist of one or more continuous functions. In detail, each continuous function is a polynomial, such as a fifth-degree polynomial, a sixth-degree polynomial, a seventh-degree polynomial, or an eighth-degree polynomial.

In the present embodiment, a curved surface function expression of the top sliding surface TS and the bottom sliding surface BS is an eighth-degree polynomial: $y(x)=ax^8+bx^6+cx^4+dx^2$. The curved surface function of the eighth-degree polynomial has a characteristic of variable curvatures, and therefore, the isolator displacement X and the normalized restoring force y' have a nonlinear relationship. Referring to FIG. 2A, because a curve of the isolator displacement X and the normalized restoring force y' has infinite number of tangential points, it indicates that the curvature of the sliding surface continuously changes. Therefore, the top sliding surface TS of the top sliding plate 120 has infinite number of curvatures, and the bottom sliding surface BS of the bottom sliding plate 110 also has infinite number of curvatures.

Referring to FIG. 1A, FIG. 1B and FIG. 2A, when the friction piece 130 slides relative to the top sliding surface TS or the bottom sliding surface BS, a change of mechanical properties of the friction piece is as follows: a softening segment SS at first and then a hardening segment HS. In the softening segment SS, the normalized restoring force y' gradually decreases as the isolator displacement X increases, which indicates that in the softening segment SS, the isolator becomes softer, thereby the transmitted seismic force and the acceleration of the seismic isolated object 200 can be reduced. In the hardening segment HS, the normalized restoring force y' gradually increases as the isolator displacement X increases, which indicates that the transmitted seismic force F and the acceleration of the isolated object 200 is increased in the hardening segment HS, but the isolator displacement X will be suppressed more effectively.

In other embodiments, when the friction piece slides relative to the top sliding surface or the bottom sliding surface, the change of mechanical properties of the friction piece may be as follows: a hardening segment at first and then a softening segment, a softening segment at first and then a hardening segment, a full hardening segment or a full softening segment, which depends on chosen curved surface function properties of the top sliding surface and the bottom sliding surface.

Figure 2B:
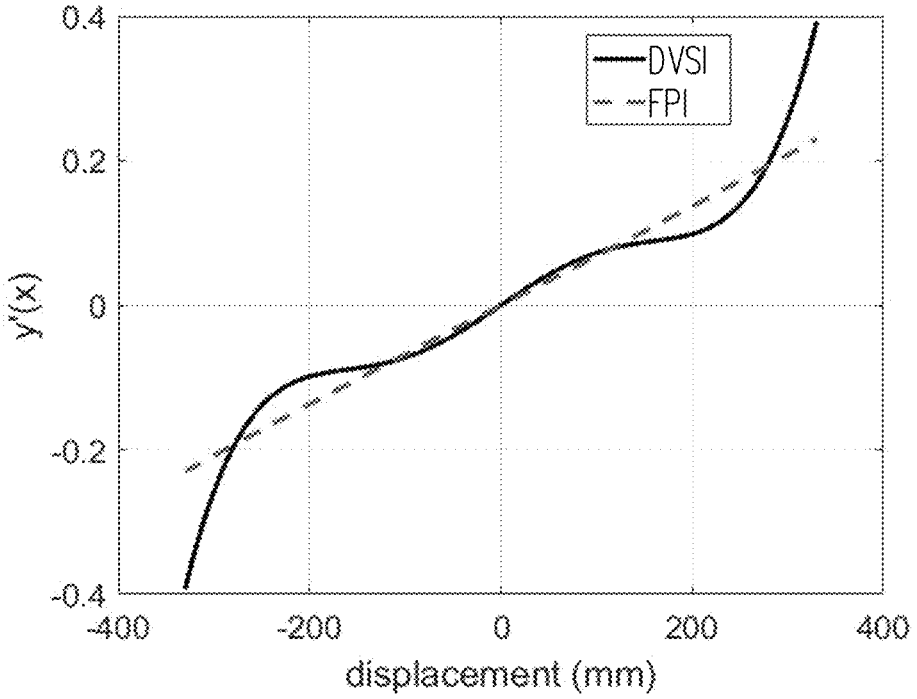
FIG. 2B is a comparison diagram between a double variable sliding isolator having variable curvatures (DVSI) and a sliding isolator having a constant curvature (FPI) in FIG. 2A.

FIG. 2B is a comparison diagram between a double variable sliding isolator having variable curvatures and a double sliding isolator having a constant curvature. Referring to FIG. 2B, in a seismic motion of a double variable sliding isolator (DVSI) adopting a curved surface function of an eighth-degree polynomial in the present embodiment, the isolator displacement X and the normalized restoring force y' have a nonlinear relationship. In a range of the isolator displacement X (0-200 mm), an increase rate of the normalized restoring force y' is smaller, and here is the softening segment. In a range of the isolator displacement X (200 mm or more), the increase rate of the normalized restoring force y' is larger, and here is the hardening segment. In comparison, an existing single-pendulum sliding isolator (FPI) adopts a curved surface having a constant curvature, so that in the swing motion, the isolator displacement X and the normalized restoring force y' have a linear relationship, which indicates that there is no softening segment and hardening segment.

Figure 2C:
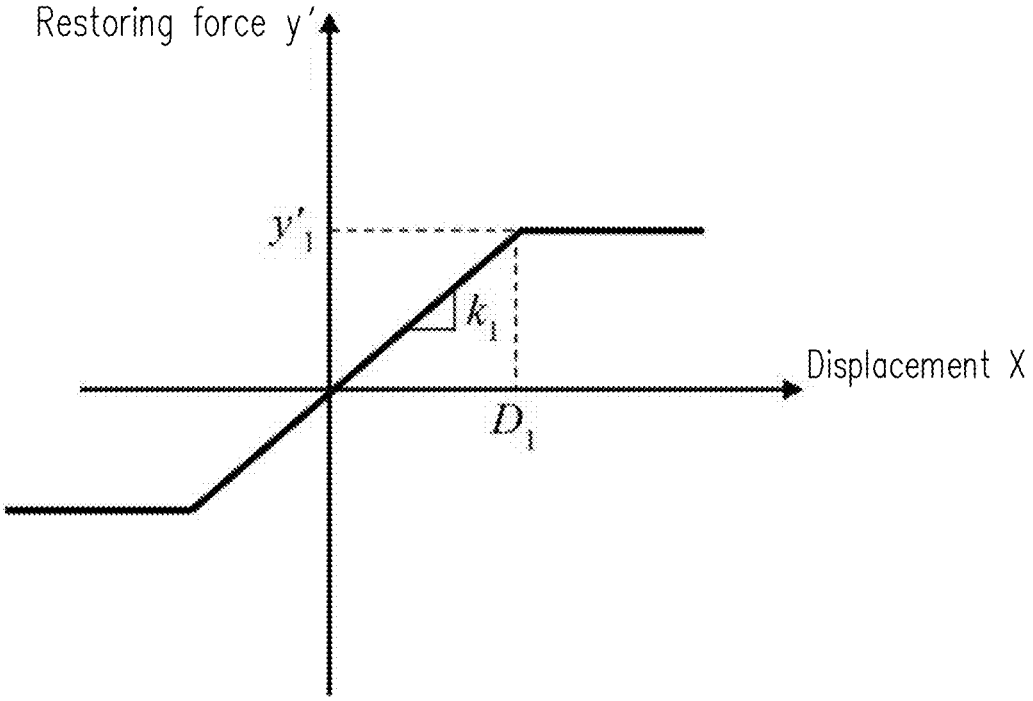
FIG. 2C is a relationship diagram between the restoring force and isolator displacement of a double variable sliding isolator adopting a curved surface function of two curvatures.

FIG. 2C is a relationship diagram between the restoring force and the isolator displacement of a single-pendulum sliding isolator adopting a curved surface function of two curvatures. Referring to FIG. 2C and FIG. 1B, in a swing motion of a double variable sliding isolator adopting a curved surface function of two curvatures in the present embodiment, the isolator displacement X and the normalized restoring force y' have a linear relationship within a specific range. After the normalized restoring force y' is increased to a certain value y'1, it will not increase any more, and the isolator displacement X will continue to increase to be greater than D1. It indicates that the double variable sliding isolator of the present embodiment may limit the normalized restoring force y' to the certain value y'1, thereby preventing excessive external forces from being transferred to the seismic isolated object 200 and causing damage.

Figure 2D:
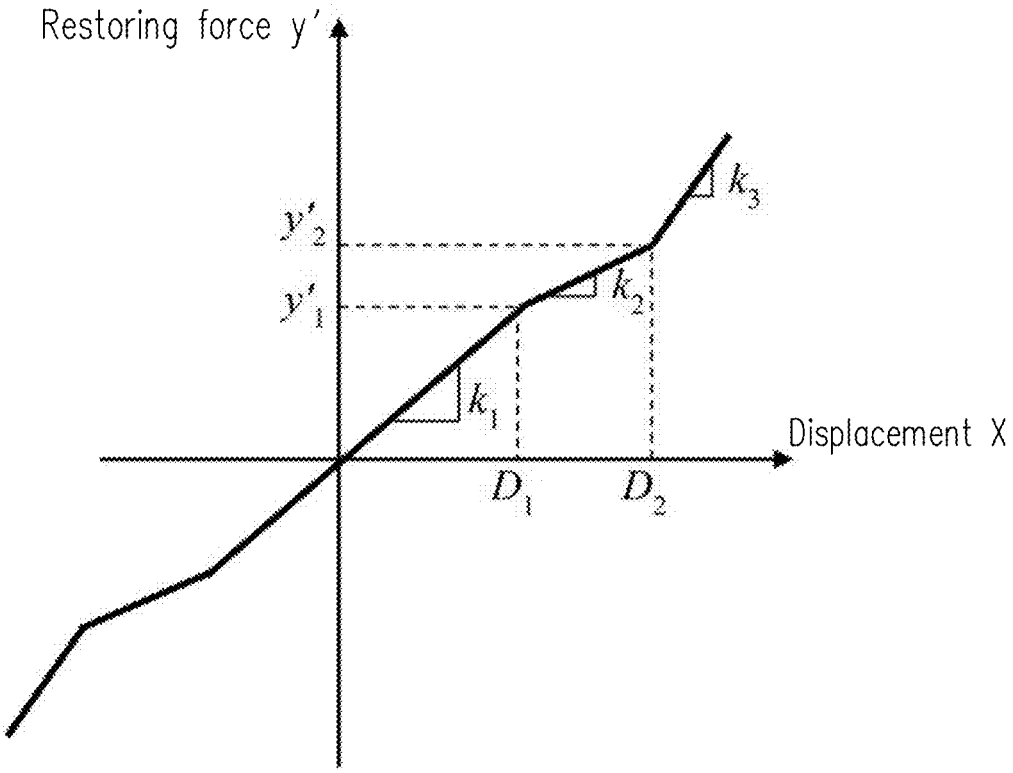
FIG. 2D is a relationship diagram between the restoring force and isolator displacement of a double variable sliding isolator adopting a curved surface function of three curvatures.

FIG. 2D is a relationship diagram between a restoring force and an isolator displacement of a double variable sliding isolator adopting a curved surface function of three curvatures. Referring to FIG. 2D and FIG. 1B, in a swing motion of a double variable sliding isolator adopting a curved surface function of three curvatures in the present embodiment, the isolator displacement X and the normalized restoring force y' have a tri-linear relationship of three slopes (k1, k2, k3). It indicates that the double variable sliding isolator of the present embodiment has different isolator stiffness under different isolator displacements X.

Briefly, in the line segment of the isolator displacement X from an initial point to a position D1, the slope of the normalized restoring force y' is k1. In the line segment of the isolator displacement X from the position D1 to a position D2, the slope of the normalized restoring force y' is k2, and the slope of the line segment k2 is less than the slope of the line segment k1, which indicates that the increase rate of the normalized restoring force y' of the line segment k2 is less than the increase rate of the normalized restoring force y' of the line segment k1. In the line segment of the isolator displacement X greater than the position D2, the slope of the normalized restoring force y' is k3, and the slope of the line segment k3 can be greater than the slope of the line segment k1, which indicates that the increase rate of the normalized restoring force y' of the line segment k3 is greater than the increase rate of the normalized restoring force y' of the line segment k1.

It indicates that a relationship between the normalized restoring force and the isolator displacement will be changed with the amplitude of the external force, and therefore, it may be selected according to practices or application cases to improve the isolation design flexibility and isolation efficiency.

Figure 3A:
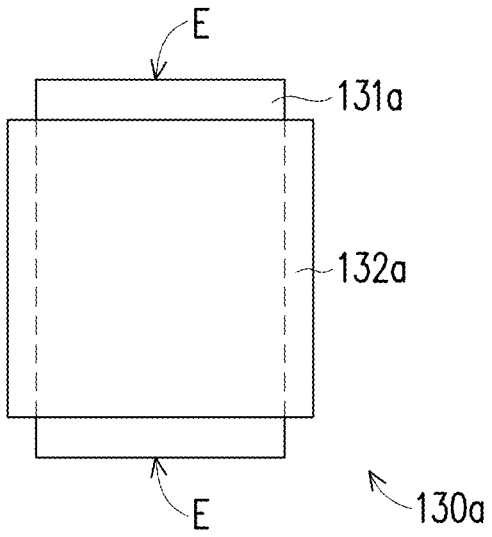
FIG. 3A is a schematic plane diagram of a friction piece according to another embodiment.

FIG. 3A is a schematic plane diagram of a friction piece according to another embodiment. Referring to FIG. 3A, the double variable sliding isolator 100 provided by the invention adopts a friction piece 130*a* of another embodiment. The friction piece 130*a* has a flexible portion 131*a* and a stiffening portion 132*a*. The flexible portion 131*a* is made of an integrally formed ductile materials, such as high molecular polyethylene material, polytetrafluoroethylene material, rubber, or other similar flexible materials and has a cylindrical appearance. The stiffening portion 132*a* surrounds and coats the outside of the flexible portion 131*a*, two ends E of the flexible portion 131*a* respectively protrude out of the stiffening portion 132*a*, and the two ends E of the flexible portion 131*a* are in contact with the bottom sliding surface BS and the top sliding surface TS respectively (referring to FIG. 1A and FIG. 1B).

Figure 3B:
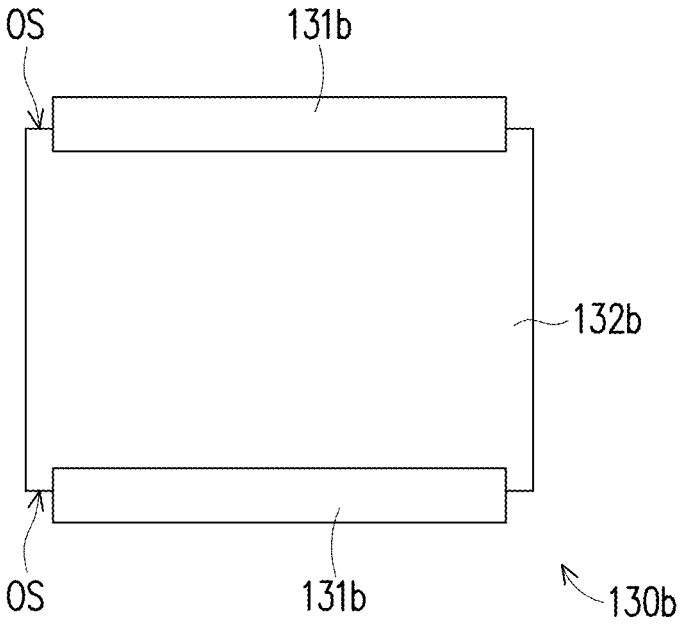
FIG. 3B is a schematic plane diagram of a friction piece according to another embodiment.

FIG. 3B is a schematic plane diagram of a friction piece according to another embodiment. Referring to FIG. 3B, the double variable sliding isolator 100 provided by the invention adopts a friction piece 130*b* of another embodiment. The friction piece 130*b* has two flexible portions 131*b* and a stiffening portion 132*b*. The two flexible portions 131*b* are respectively embedded on two opposite outer side surfaces OS of the stiffening portion 132*b*. The two flexible portions 131*b* are in contact with the bottom sliding surface BS and the top sliding surface TS respectively (referring to FIG. 1A and FIG. 1B).

Figure 3C:
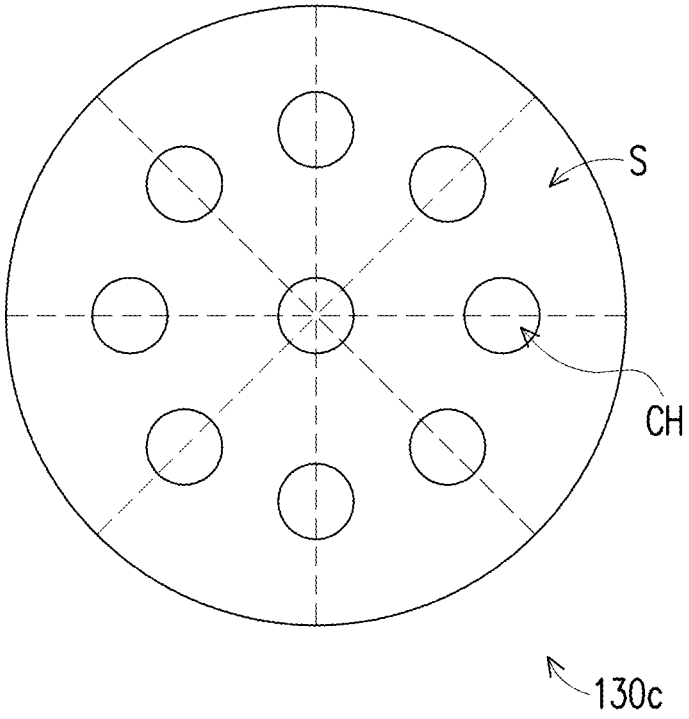
FIG. 3C is a top schematic plane diagram of a friction piece having concave holes according to another embodiment.

FIG. 3C is a top schematic plane diagram of a friction piece having concave holes according to another embodiment. Referring to FIG. 3C, the double variable sliding isolator 100 provided by the invention adopts a friction piece 130*c* of another embodiment. The friction piece 130*c* has a plurality of concave holes CH formed in two loading surfaces S in contact with the bottom sliding surface BS and the top sliding surface TS respectively and configured to improve heat dissipation efficiency when each carrying surface S is in contact with the bottom sliding surface BS and the top sliding surface TS, and the plurality of concave holes CH have a function of preserving a lubricant. Further, a lubricant is disposed in the plurality of concave holes CH of the friction piece 130*c* and configured to reduce kinetic friction coefficients between each loading surface S and the bottom sliding surface BS as well as the top sliding surface TS (referring to FIG. 1A and FIG. 1B).

Figure 3D:
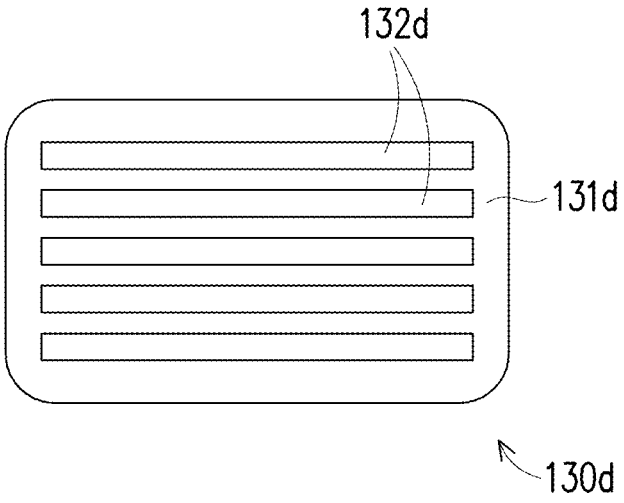
FIG. 3D is a schematic plane diagram of a composite friction piece according to another embodiment.

FIG. 3D is a schematic plane diagram of a composite friction piece according to another embodiment. Referring to FIG. 3D, the double variable sliding isolator 100 provided by the invention adopts a friction piece 130*d* of another embodiment. The friction piece 130*d* of the present embodiment has a plurality of stiffening portions 132*d* and a flexible portion 131*d*. The flexible portion 131*d* coats the outside of the plurality of stiffening portions 132*d*, and the flexible portion 131*d* and the plurality of stiffening portions 132*d* are level with each other to form a columnar structure. The plurality of stiffening portions 132*d* are disposed at intervals. Because the flexible portion 131*d* is made of the high molecular polyethylene material, the polytetrafluoroethylene material, the rubber material, or similar polymer material, the plurality of stiffening portions 132*d* are disposed in the flexible portion 131*d* at intervals and may be configured to improve structural rigidity of the friction piece 130*d*.

Figure 3E:
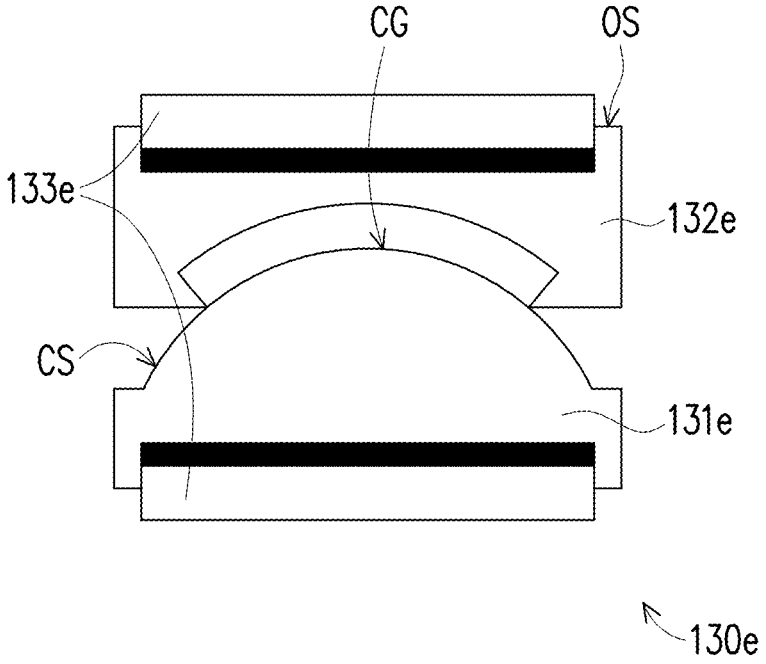
FIG. 3E is a schematic plane diagram of a ball-and-socket friction piece according to another embodiment.

FIG. 3E is a schematic plane diagram of a ball-and-socket friction piece according to another embodiment. Referring to FIG. 3E, the double variable sliding isolator 100 provided by the invention adopts a friction piece 130*e* of another embodiment. The friction piece 130*e* of the present embodiment has a first base 131*e*, a second base 132*e* and two flexible portions 133*e*. The first base 131*e* is connected to the second base 132*e* to form a ball-and-socket structure, and the first base 131*e* and the second base 132*e* are adapted to pivotally rotate relative to each other. The two flexible portions 133*e* are respectively embedded on two opposite outer side surfaces OS of the first base 131*e* and the second base 132*e*, and the two flexible portions 133*e* are in contact with the bottom sliding surface BS and the top sliding surface TS respectively.

In detail, in the friction piece 130*e* of the present embodiment, the first base 131*e* has a protruding spherical surface CS, and the second base 132*e* has a groove CG. The protruding spherical surface CS is disposed upward in the groove CG, so that the first base 131*e* and the second base 132*e* are adapted to pivotally rotate relative to each other.

Figure 4A:
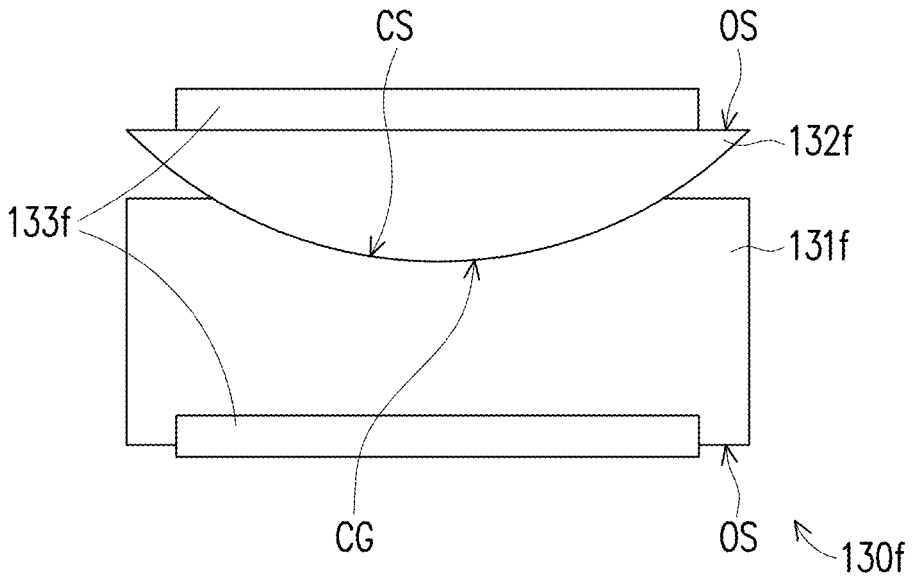
FIG. 4A is a schematic plane diagram of an articulate friction piece according to another embodiment.
Figure 4B:
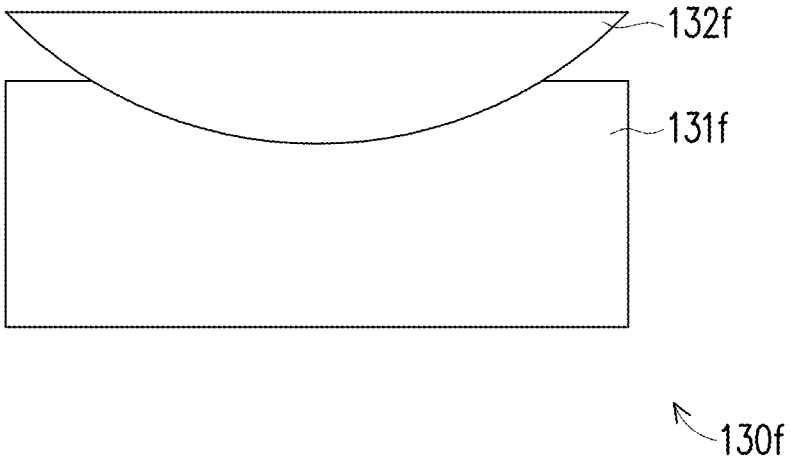
FIG. 4B is a schematic plane diagram of an articulate friction piece portions according to another embodiment.

FIG. 4A is a schematic plane diagram of an articulate friction piece according to another embodiment. FIG. 4B is a schematic plane diagram of an articulate friction piece portions according to another embodiment.

Referring to FIG. 4A, the double variable sliding isolator 100 provided by the invention adopts a friction piece 130*f* of another embodiment. The friction piece 130*f* of the present embodiment has a first base 131*f*, a second base 132*f* and two flexible portions 133*f*. The first base 131*f* is connected to the second base 132*f* to form an articulate structure, and the first base 131*e* and the second base 132*e* are adapted to pivotally rotate relative to each other. The two flexible portions 133*f* are respectively embedded on two opposite outer side surfaces OS of the first base 131*f* and the second base 132*f*, and the two flexible portions 133*f* are in contact with the bottom sliding surface BS and the top sliding surface TS respectively. In detail, the first base 131*f* has a groove CG, and the second base 132*f* has a protruding spherical surface CS. The protruding spherical surface CS is disposed downward in the groove CG, so that the first base 131*f* and the second base 132*f* are adapted to pivotally rotate relative to each other.

Referring to FIG. 4B, in another embodiment, the first base 131*f* and the second base 132*f* are integrated with the two flexible portions respectively and made of low-friction ductile materials.

Figure 4C:
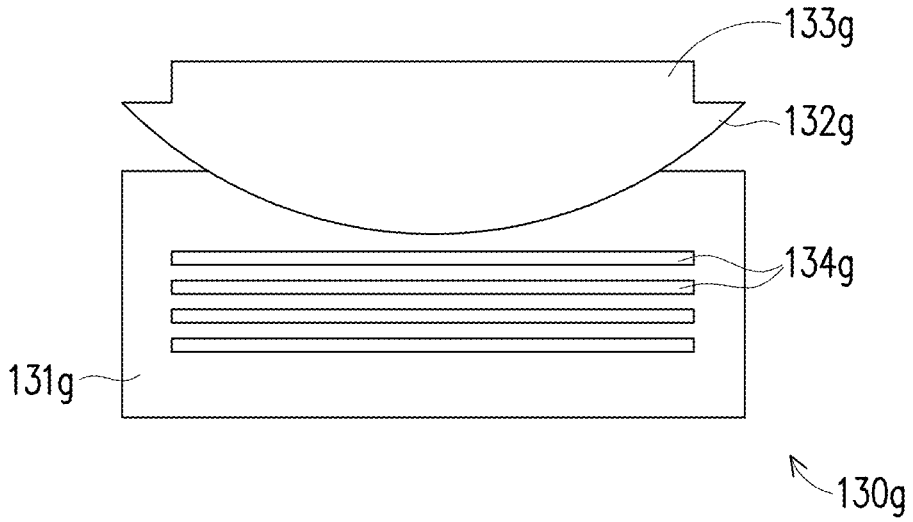
FIG. 4C is a schematic plane diagram of an articulate friction piece according to another embodiment.

FIG. 4C is a schematic plane diagram of an articulate friction piece according to another embodiment. A friction piece 130*g* of the present embodiment is similar to the friction piece 130*f* as shown in FIG. 4A. A difference between the friction piece 130*g* and the friction piece 130*f* is as follows: the friction piece 130*g* further includes a plurality of stiffening portions 134*g* embedded on a first base 131*g* or a second base 132*g* (embedded on the first base 131*g* in FIG. 4A) at intervals and configured to improve structural rigidity of the first base 131*g* or the second base 132*g*. In the present embodiment, the first base 131*g* is made of low-friction ductile materials. In other embodiments, the plurality of stiffening portions 134*g* may be embedded on the first base 131*g* and the second base 132*g* simultaneously.

Figure 4D:
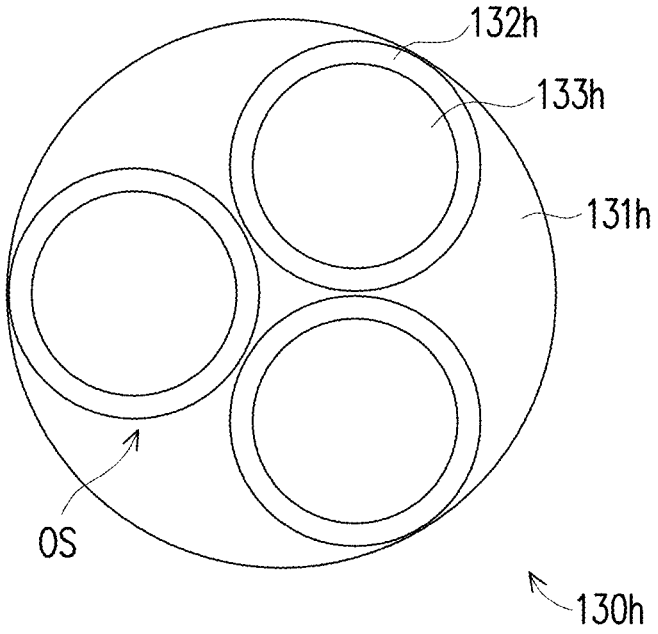
FIG. 4D is a schematic plane diagram of a multi-articulate friction piece according to another embodiment.
Figure 4E:
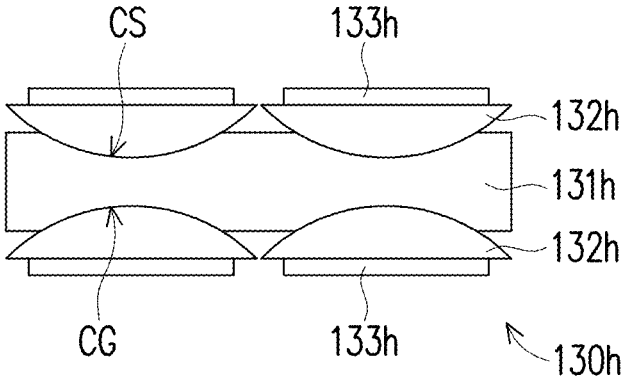
FIG. 4E is a schematic side diagram of the multi-articulate friction piece in FIG. 4E.

FIG. 4D is a schematic plane diagram of a multi-articulate friction piece according to another embodiment. FIG. 4E is a schematic side diagram of the multi-articulate friction piece in FIG. 4D. Referring to FIG. 4D and FIG. 4E, the double variable sliding isolator 100 provided by the invention adopts a friction piece 130*h* of another embodiment.

The friction piece 130*h* has a first base 131*h*, a plurality of second bases 132*h* and a plurality of flexible portions 133*h*. The first base 131*h* has a plurality of grooves CG formed in two opposite outer side surfaces OS of the first base 131*h* respectively. Each second base 132*h* has a protruding spherical surface CS, and a plurality of protruding spherical surfaces CS of the plurality of second bases 132*h* are respectively disposed in the plurality of corresponding grooves CG, so that each second base 132*h* and the first base 131*h* are adapted to pivotally rotate relative to each other. The plurality of flexible portions 133*h* are respectively embedded on the plurality of second bases 132*h* and are away from the plurality of grooves CG, and the plurality of flexible portions 133*h* are respectively configured to be in contact with the bottom sliding surface BS and the top sliding surface TS (referring to FIG. 1A and FIG. 1B).

In addition, the friction piece 130*h* of the present embodiment is adapted to a top sliding plate and a bottom sliding plate of a large sliding surface area. In a seismic isolation motion of the double variable sliding isolator 100, each second base 132*h* is adapted to pivotally rotate relative to the first base 131*h* so as to adjust contact positions of the plurality of flexible portions 133*h* along the top sliding plate and the bottom sliding plate, so that excessive friction between the flexible portions 133*h* and the top sliding plate as well as the bottom sliding plate may be reduced so as to relieve an abrasion degree of each flexible portion 133*h* in the seismic isolation motion.

Further, in order to reduce an abrasion degree of the friction piece between the top sliding plate and the bottom sliding plate, a lubricant is disposed between the friction piece and the bottom sliding surface as well as the top sliding surface and configured to reduce kinetic friction coefficients between the friction piece and the bottom sliding surface as well as the top sliding surface.

Figure 5A:
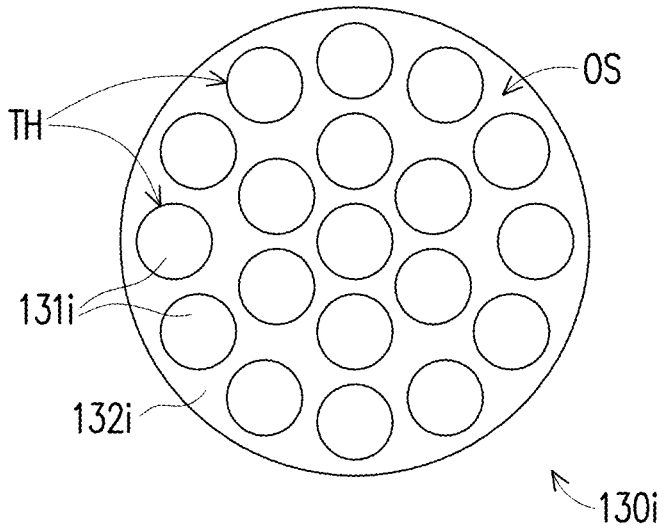
FIG. 5A is a schematic top diagram of a friction piece having multi-flexible portions according to another embodiment.
Figure 5B:
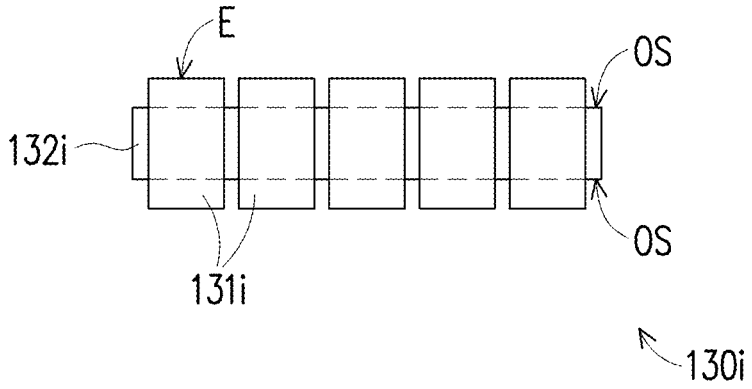
FIG. 5B is a schematic side diagram of the friction piece having multi-flexible flexible portions in FIG. 5A.

FIG. 5A is a schematic top diagram of a friction piece having a plurality of flexible portions according to another embodiment. FIG. 5B is a schematic side diagram of the friction piece having the plurality of flexible portions in FIG. 5A.

Referring to FIG. 5A and FIG. 5B, the double variable sliding isolator 100 provided by the invention adopts a friction piece 130*i* of another embodiment. The friction piece 130*i* has a stiffening portion 132*i* and a plurality of flexible portions 131*i*. The stiffening portion 132*i* has a plurality of containing through holes TH penetrating through two opposite outer side surfaces OS of the stiffening portion 132*i*. The plurality of flexible portions 131*i* may be of a columnar structure and respectively penetrate through the plurality of containing through holes TH of the stiffening portion 132*i*, two ends E of each flexible portion 131*i* respectively protrude out of the two outer side surfaces OS of the stiffening portion 132*i*, and the two ends E of each flexible portion 131*i* are in contact with the bottom sliding surface and the top sliding surface respectively.

Figure 5C:
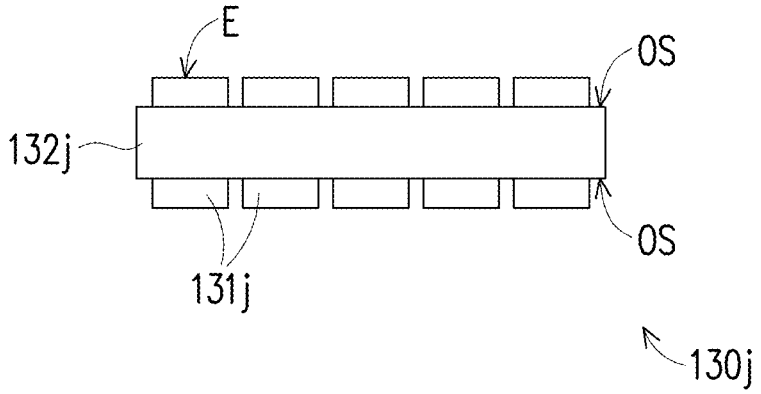
FIG. 5C is a schematic side diagram of the friction piece having multi-flexible flexible portions according to another embodiment.

FIG. 5C is a schematic side diagram of the friction piece having multi-flexible flexible portions according to another embodiment.

Referring to FIG. 5C, the double variable sliding isolator 100 provided by the invention adopts a friction piece 130*j* of another embodiment. The friction piece 130*j* has a stiffening portion 132*j* and a plurality of flexible portions 131*j*. The plurality of flexible portions 131*j* may be of a columnar structure and respectively installed on two opposite outer side surfaces OS of the stiffening portion 132*j*, and the flexible portion 131*j* are in contact with the bottom sliding surface and the top sliding surface respectively.

In addition, the stiffening portion is made of steel, carbon fiber or a flexible material, and the plurality of flexible portions are made of ductile materials, such as ultra-high-molecular-weight polyethylene, polytetrafluoroethylene, rubber, or other similar flexible materials. In the present embodiment, by combining the plurality of flexible portions, an effect of improving the loading capacity may be achieved.

Figure 6A:
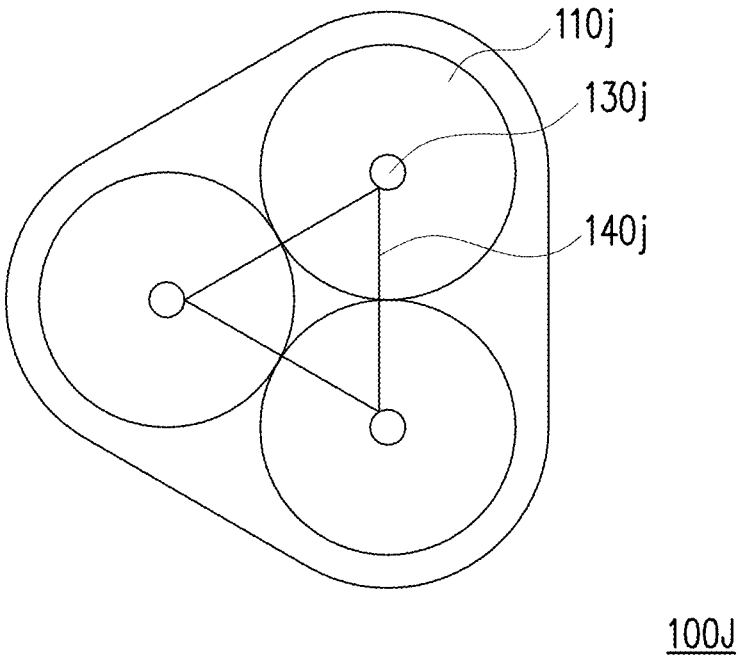
FIG. 6A is a schematic top diagram of a double variable sliding isolator according to another embodiment of the invention.
Figure 6B:
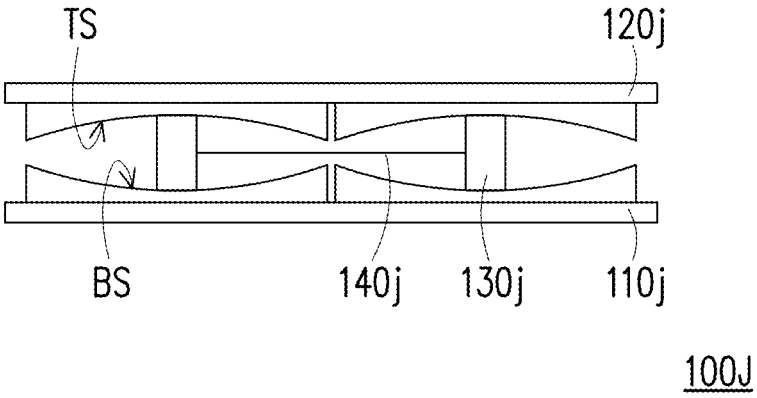
FIG. 6B is a schematic side diagram of the double variable sliding isolator in FIG. 6A.

FIG. 6A is a schematic top diagram of a double variable sliding isolator according to another embodiment of the invention. FIG. 6B is a schematic side diagram of a double variable sliding isolator according to another embodiment of the invention.

Referring to FIG. 6A and FIG. 6B, a double variable sliding isolator 100J of the present embodiment is different from the double variable sliding isolator 100 as shown in FIG. 1A and FIG. 1B. A difference between the double variable sliding isolator 100J and the double variable sliding isolator 100 is as follows: the double variable sliding isolator 100J includes a plurality of bottom sliding plates 110*j*, a plurality of top sliding plates 120*j* and a plurality of friction pieces 130*j*. Each bottom sliding plate 110*j* has a bottom sliding surface BS, and each bottom sliding surface BS has at least two curvatures. The plurality of top sliding plates 120*j* are located over the plurality of bottom sliding plates 110*j*, each top sliding plate 120*j* has a top sliding surface TS, and each top sliding surface TS has at least two curvatures. Each friction piece 130*j* is slidably disposed between each corresponding top sliding plate 110*j* and each corresponding bottom sliding plate 120*j*, and each friction piece is in contact with each bottom sliding surface BS and each top sliding surface TS respectively.

The double variable sliding isolator 100J further includes a plurality of connecting rods 140*j*. Each connecting rod 140*j* is connected to two of the plurality of friction pieces 130*j* to enable the plurality of friction pieces 130*j* to be connected as a whole and linked to each other.

When an external force F is applied to the plurality of bottom sliding plates 110*j* and the plurality of top sliding plates 120*j*, the bottom sliding plates 110*j* and the top sliding plates 120*j* are adapted to generate relative displacements, so that each friction piece 130*j* slides along each corresponding bottom sliding surface BS and each corresponding top sliding surface TS.

In brief, the double variable sliding isolator 100J of the present embodiment is composed of a plurality of sets of bottom sliding plates 110*j*, top sliding plates 120*j* and friction pieces 130*j*, thereby improving the loading capacity.

Figure 7A:
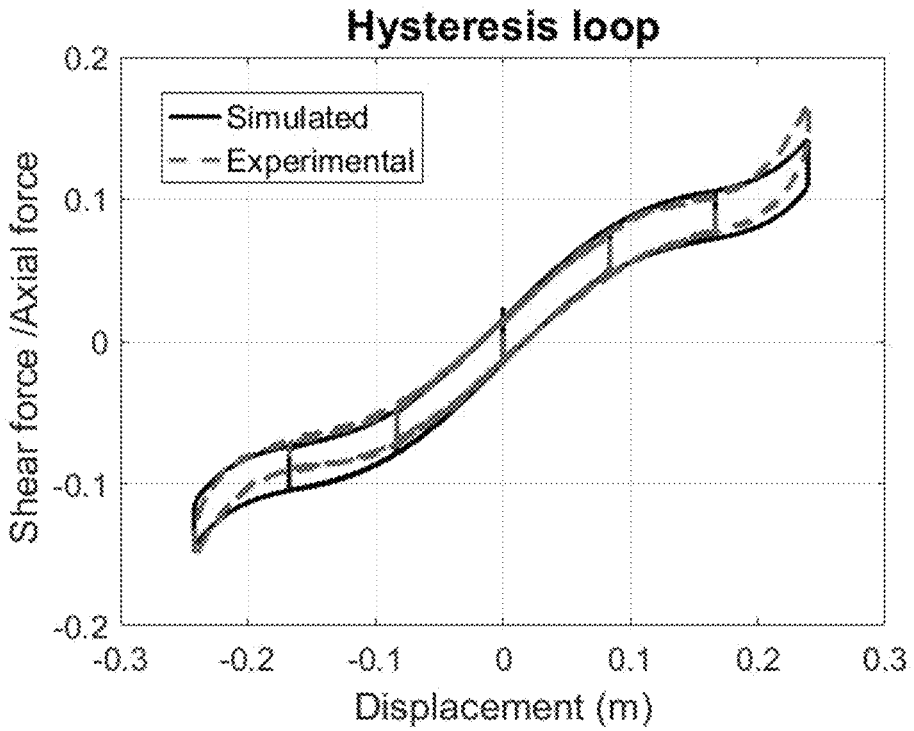
FIG. 7A is a hysteresis loop of the double variable sliding isolator in FIG. 1A under a condition of lubricated friction.
Figure 7B:
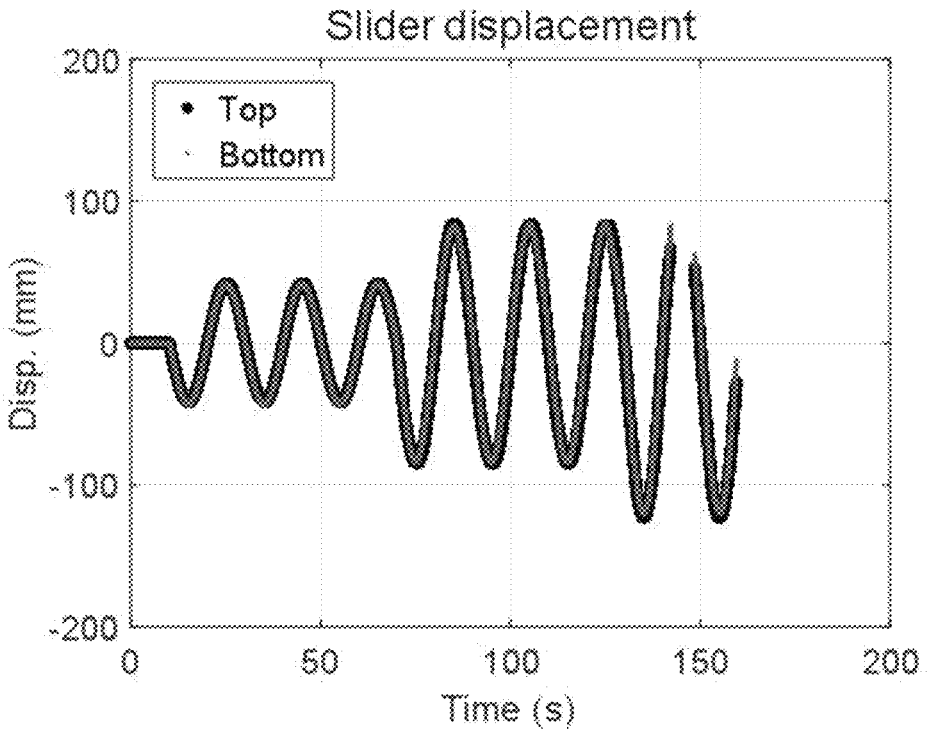
FIG. 7B is an actually measured displacement diagram of the top and bottom sliding plates of the double variable sliding isolator in FIG. 7A.

FIG. 7A is an actually measured hysteresis loop diagram of the double variable sliding isolator in FIG. 1A under a condition of lubricated friction. FIG. 7B is the measured displacement diagram of the friction piece of the double variable sliding isolator in FIG. 7A.

Referring to FIG. 1A, FIG. 1B, FIG. 7A and FIG. 7B, the friction piece 130 is of a columnar structure and is made of ultra-high-molecular-weight polyethylene. The friction piece 130 is in lubricated friction with the bottom sliding plate 110 and the top sliding plate 120, and the friction piece 130 further has concave holes CH filled with lubricant. Under a cyclic isolator element test with an unidirectional simple harmonic excitation (amplitude: 80, 160, and 240 MM, frequency: 0.05 Hz, axial pressure: 40 KN), a hysteresis loop of the double variable sliding isolator obtained from the test is shown in FIG. 7A and is quite close to a simulated hysteresis loop. The actually measured displacements of the top sliding plate 120 and the bottom sliding plate 110 relative to the friction piece 130 are shown in FIG. 7B, which shows mutually symmetrical behavior of the top sliding plate 120 and the bottom sliding plate 110. It indicates that in the seismic isolation motion of the double variable sliding isolator 100 of the present embodiment, stresses at two ends E of the friction piece 130 are similar, thereby achieving a good seismic isolation effect.

In conclusion, the double variable sliding isolator provided by the invention has the top sliding plate and the bottom sliding plate, and each of the top sliding surface and the bottom sliding surface respectively has at least two curvatures. Different from an existing single-pendulum isolator having a constant curvature, a double variable sliding isolator having variable curvatures is capable of avoiding the problem of excessive isolator displacement when subjected to near-field earthquakes with strong long-period components. Furthermore, in a seismic isolation motion of the double variable sliding isolator, the normalized restoring force and the isolator displacement of the double variable sliding isolator are not of a linear relationship, but a non-linear relationship based on chosen different curvatures. Therefore, the double variable sliding isolator has more design flexibility and variability and is suitable to buildings or equipment with different seismic isolation requirements.

Furthermore, compared with the existing single-pendulum isolator of the same isolator displacement capacity, the double variable sliding isolator provided by the invention has the advantage of smaller size.

What is claimed is:

1. A double variable sliding isolator, comprising:

a bottom sliding plate, comprising a bottom sliding surface;

a top sliding plate, disposed over the bottom sliding plate and comprising a top sliding surface; and a friction piece, slidably disposed between the top sliding plate and the bottom sliding plate and being in contact with the bottom sliding surface and the top sliding surface respectively, wherein when an external force is applied to the bottom sliding plate and the top sliding plate, the bottom sliding plate and the top sliding plate are adapted to generate a relative displacement, so that the friction piece slides along the bottom sliding surface and the top sliding surface, wherein the bottom sliding surface of the bottom sliding plate and the top sliding surface of the top sliding plate are symmetrically disposed, wherein the top sliding surface and the bottom sliding surface consist of one or a plurality of continuous functions, wherein at least one of the continuous functions is a polynomial, wherein at least one of the continuous functions is an eighth-degree polynomial $y(x)=ax^8+bx^6+cx^4+dx^2$.

2. The double variable sliding isolator according to claim 1, wherein when the friction piece slides relative to the top sliding surface or the bottom sliding surface, a change of mechanical properties of the friction piece is as follows: a softening segment at first and then a hardening segment, a hardening segment at first and then a softening segment, a full hardening segment or a full soften segment.

3. The double variable sliding isolator according to claim 1, wherein the friction piece comprises a stiffening portion and two flexible portions, the two flexible portions are respectively embedded on two opposite outer side surfaces of the stiffening portion, and the two flexible portions are in contact with the bottom sliding surface and the top sliding surface respectively.

4. The double variable sliding isolator according to claim 1, wherein the friction piece comprises a stiffening portion and a plurality of flexible portions, the stiffening portion comprises a plurality of containing through holes penetrating through two opposite outer side surfaces of the stiffening portion, the flexible portions respectively penetrate through the plurality of containing through holes of the stiffening portion, two ends of each flexible portion respectively protrude out of the two outer side surfaces, and the two ends of each flexible portion are in contact with the bottom sliding surface and the top sliding surface respectively.

5. The double variable sliding isolator according to claim 4, wherein the stiffening portion is made of steel, carbon fiber or a flexible material, and the flexible portions are made of ductile materials, such as ultra-high-molecular-weight polyethylene, polytetrafluoroethylene, rubber, or other similar flexible materials.

6. The double variable sliding isolator according to claim 1, wherein the friction piece comprises a plurality of stiffening portions and a flexible portion, the flexible portion coats the stiffening portions and is level with the stiffening portions, and the stiffening portions are disposed at intervals.

7. The double variable sliding isolator according to claim 1, wherein the friction piece comprises a first base, a second base and two flexible portions, the first base is connected to the second base, the first base and the second base are adapted to pivotally rotate relative to each other, the two flexible portions are respectively embedded on two opposite outer side surfaces of the first base and the second base, and the two flexible portions are in contact with the bottom sliding surface and the top sliding surface respectively.

8. The double variable sliding isolator according to claim 1, wherein the friction piece comprises a first base, a second base and two flexible portions, the first base comprises a groove or a protruding spherical surface, the second base comprises a protruding spherical surface or a groove, and the protruding spherical surface is disposed in the groove, so that the first base and the second base are adapted to pivotally rotate relative to each other, the two flexible portions are respectively disposed on two opposite outer side surfaces of the first base and the second base.

9. The double variable sliding isolator according to claim 8, wherein the first base and the second base are integrated with the two flexible portions respectively.

10. The double variable sliding isolator according to claim 7, further comprising a plurality of stiffening portions embedded on the first base or the second base at intervals and configured to improve structural rigidity of the first base or the second base.

11. The double variable sliding isolator according to claim 1, wherein the friction piece comprises a first base, a plurality of second bases and a plurality of flexible portions, the first base comprises a plurality of grooves formed in two opposite outer side surfaces of the first base respectively, each second base comprises a spherical surface, the spherical surfaces of the second bases are respectively disposed in the corresponding grooves, so that each second base and the first base are adapted to pivotally rotate relative to each other, the flexible portions are respectively embedded on the second bases and are away from the grooves, and the flexible portions are in contact with the bottom sliding surface and the top sliding surface respectively.

12. The double variable sliding isolator according to claim 1, wherein a lubricant is disposed between the friction piece and the bottom sliding surface as well as the top sliding surface and configured to reduce friction coefficients between the friction piece and the bottom sliding surface as well as the top sliding surface.

13. The double variable sliding isolator according to claim 1, wherein the friction piece comprises a plurality of concave holes formed in two loading surfaces in contact with the bottom sliding surface and the top sliding surface respectively and configured to improve heat dissipation efficiency when each loading surface is in contact with the bottom sliding surface and the top sliding surface.

14. The double variable sliding isolator according to claim 13, wherein a lubricant is disposed in the concave holes of the friction piece to preserve the lubricant, and the lubricant is configured to reduce friction coefficients between each loading surface and the bottom sliding surface as well as the top sliding surface.

15. The double variable sliding isolator according to claim 1, wherein the friction piece is integrally formed, and the friction piece is made of ductile materials, such as ultra-high-molecular-weight polyethylene, polytetrafluoroethylene, rubber, or other similar flexible materials.

16. The double variable sliding isolator according to claim 1, wherein the friction piece is a column.

* * * * *